United States Patent [19]

McKibben et al.

[11] Patent Number: 5,071,487

[45] Date of Patent: Dec. 10, 1991

[54] METHOD AND APPARATUS FOR CLEANING PASSAGEWAYS IN METAL CASTINGS

[75] Inventors: Kenneth D. McKibben, Defiance, Ohio; Thomas E. Wuepper, Alger, Mich.

[73] Assignee: CMI International, Inc., Southfield, Mich.

[21] Appl. No.: 481,629

[22] Filed: Feb. 16, 1990

[51] Int. Cl.[5] ..... B08B 9/093

[52] U.S. Cl. ..... 134/22.18; 134/22.12; 134/33; 15/304; 15/308; 15/306.1; 15/316.1; 15/318

[58] Field of Search ..... 134/22.18, 33, 22.12; 15/304, 306 B, 316 A, 308, 316 R

[56] References Cited

U.S. PATENT DOCUMENTS

| | | | |
|---|---|---|---|
| 3,117,726 | 1/1964 | Schoberg | 239/291 |
| 3,159,164 | 12/1964 | McBrady | 134/69 |
| 3,419,429 | 12/1968 | Zadron et al. | 134/33 |
| 3,989,537 | 11/1976 | Sickmeier | 134/1 |
| 4,325,161 | 4/1982 | Wood et al. | 15/304 |
| 4,639,968 | 2/1987 | McKibben et al. | 15/304 |

*Primary Examiner*—Theodore Morris
*Assistant Examiner*—Saeed Chaudhry
*Attorney, Agent, or Firm*—Harness, Dickey & Pierce

[57] ABSTRACT

Metals castings, having a number of internal passageways which open at different surface portions of the castings, are mounted upon a horizontally axised wheel-like frame. The frame is intermittently rotated and momentarily stopped so that castings are rotated at times and stationary at times. During the times that the castings are stationary, they are simultaneously subjected to either an externally applied vibration or to a momentary, several millisecond long, high pressure burst of air through their respective passageways. The alternating vibrations and momentary bursts of air loosen and remove the sand and other casting debris contained within the passageways. Additionally, the changing angularity of the castings, due to the rotation, coupled with the vibrations and bursts of air, dislodge such sand and debris from the walls and, also, downwardly out of the passageways.

9 Claims, 1 Drawing Sheet

METHOD AND APPARATUS FOR CLEANING PASSAGEWAYS IN METAL CASTINGS

BACKGROUND OF INVENTION

This invention relates to cleaning sand and other casting debris from the interior passageways formed in a sand cast, metal casting. Cast metal parts are commonly made by pouring molten metal into cavities formed in sand molds. Upon solidification of the metal, the sand mold is broken and the sand is separated from the metal part. Frequently, sand particles and other casting debris are lodged upon or adhered to the surfaces of the metal part. This material is removed through various cleaning techniques.

In casting a part which has interior passageways or hollow portions, it is common to use a core which may be made of sand and a suitable adhesive or resin, baked or otherwise solidified to form an obstacle around which the molten metal is cast within the sand mold cavity. After the metal is solidified, the interior core is broken out or otherwise removed, leaving the passageways or hollow portions within the casting. The removal of sand particles or other casting debris from the interior of the cast part, that is, from within the interior cavities or passageways is somewhat difficult and takes considerable time, depending upon the nature and shape of the part.

By way of example, cast internal combustion engine parts, such as the engine head or the engine block, are formed with numerous internal passageways which are difficult to clean following the casting of the metal. In high production foundries, the amount of time and material required for cleaning a casting, particularly the interior passageways and cavities within the casting, is important and, therefore, efforts have been made to clean such parts rapidly and effectively in order to reduce the expense of manufacturing the part.

An example of equipment developed for cleaning castings is disclosed in my prior U.S. Pat. No. 4,639,968, issued Feb. 3, 1987 to McKibben, Gould, Groh and Wuepper, for a Machine for Cleaning Castings. This patent illustrates a wheel, which rotates about a horizontal axis, upon which castings are mounted for movement through a number of cleaning stations. Alternating high pressure and low pressure blasts of air are applied to openings in the castings in opposite directions so as to loosen and blow out adhered sand or other debris. But, that equipment, and other available cleaning equipment are not always able to remove adhered sand and other debris from some relative long or curved interior spaces or of passageways formed within some cast metal parts. In the case of some cast engine parts, particularly engine heads and manifold parts having long and multiply curved internal passageways, there has been a need for a faster acting mechanism and method for better cleaning such castings in high production facilities.

Consequently, the invention herein concerns an improved method and apparatus cleaning the interior passageways of a cast part involving repetative, alternating cycles of first, vibrating the entire casting and, second, applying an extremely short duration, high pressure air blast into the passageways.

SUMMARY OF THE INVENTION

This invention is concerned with rapidly cleaning interior passageways and cavities formed during the casting of metal parts in sand casting operations, by alternatingly applying vibrations to the casting and high powered, short duration bursts of highly compressed air blasts through the passageways, while rotating the castings between the periodic vibration and air blast applications. Cast metal parts are attached to a rotating, horizontally axised, ferris wheel-like frame and are rotated by the frame through a number of stations which alternatively apply vibration and the bursts of air until a 360 degree rotation of the part is achieved. Then, the casting is removed from the frame. The frame simultaneously supports a number of castings for mass production cleaning.

An object of this invention is to provide an inexpensive, very rapid and effective means for cleaning internal passageways in cast parts, utilizing little, if any, manual labor so as to reduce the manufacturing costs of the part.

A further object of this invention is to provide a mass production system for cleaning metal parts that are cast in sand molds which utilize cores for forming internal passageways within the cast parts.

Another object of this invention is t provide a means for cleaning the internal passageways of a cast metal part by utilizing a high pressure burst of air applied through the passageways for a very short time period, such as a few milliseconds, to produce an explosion-like effect within the passageways. The short burst of air is alternatingly applied between applications of vibrations to the cast metal part and the part is turned relative to the horizontal, so that the interior cavities and passageways of the casting are cleaned automatically without hand labor.

These and other objects and advantages of this invention will become apparent upon reading the following description, of which the attached drawings form a part.

DETAILED DESCRIPTION

Figure 1:
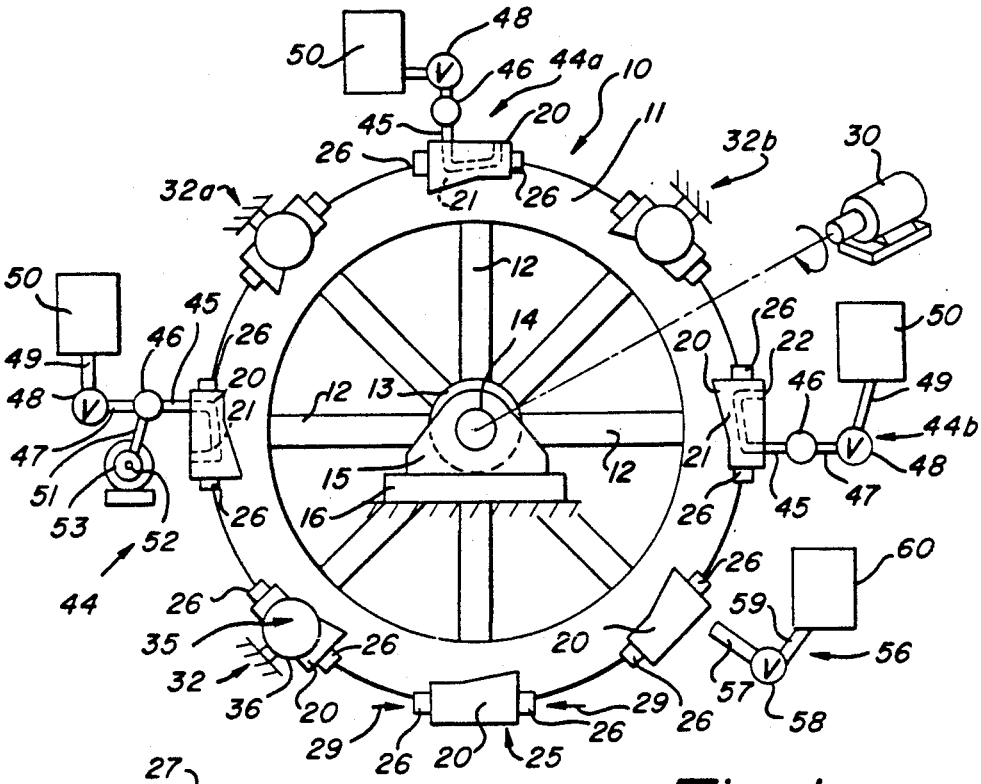
FIG. 1 is a schematic, elevational view of the equipment carrying a number of cast parts for cleaning.

FIG. 1 schematically illustrates an apparatus for cleaning castings. The apparatus includes a wheel-like frame 10 having a rim 11, connected by spokes 12 to a hub 13. The hub is mounted upon an axle 14 which is supported in bearings 15. The bearings are mounted upon a fixed support 16, which is schematically illustrated.

Figure 2:
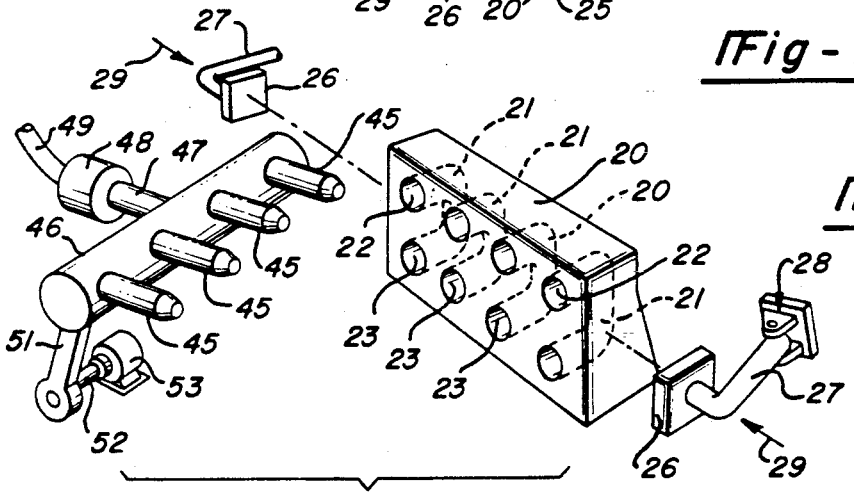
FIG. 2 is a schematic, fragmentary, perspective view showing a cast part and the air blast nozzle arrangement.

A cast metal part 20, as for example a cast iron block-like part, is provided with internal passageways 21. The shapes, lengths and number of the passageways or other cavities may vary considerably. For illustration purposes, the passageways or cavities are shown being U-shaped with opposite end openings 22 and 23 which communicate with different portions of a surface of the casting see FIG. 2. The passageways may extend completely through the cast metal part, in a more straight direction, or may be otherwise curved in shape. In addition, instead of longer passageways, the part may include cavities of various shapes which communicate to exterior portions of the surfaces of the casting through openings. Thus, the use of the passageways includes other cavities.

The casting is mounted upon the ferris wheel-like frame 10 at a lower loading station 25. Suitable clamps 26 which are schematically illustrated as being mounted upon levers 27 that are pivotally connected, through pivot brackets 28, upon the wheel rim 11, grasp and clamp the cast part see FIG. 2. A suitable mechanism is provided (not shown) for pivoting the clamp levers and holding the clamps in clamping engagement with the cast part. That movement is illustrated by arrows 29, shown in FIGS. 1 and 2. The particular construction of the mechanism for operating the clamps and the clamp construction may vary considerably and may be selected, from commercially available clamping systems, by those skilled in the art.

Figure 3:
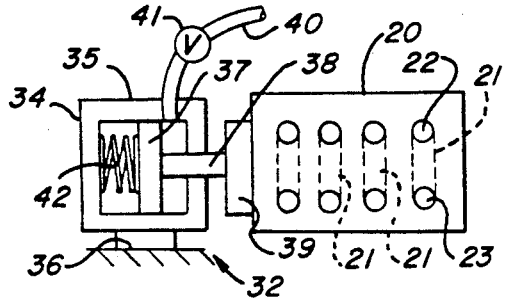
FIG. 3 is a schematic, fragmentary, partially cross-sectional view, showing a vibrator applying vibration to a cast part.

The wheel-like frame is rotated, for example, in a clockwise direction, by means of a suitable motor 30 connected to the axle 14 through an appropriate speed control and the cast part is rotated or indexed through a number of stations. The second station 32 is provided with a vibrating mechanism. Referring to FIG. 3, the vibrating station 32 includes a vibrator 34 which is schematically shown as comprising a cylinder 35 mounted upon a fixed support 36 adjacent the wheel frame. Thus, the vibrating station 32 is stationary relative to the rotating wheel.

The vibrator cylinder 34 includes a piston 37 having a piston rod 38 which extends outwardly of the cylinder and carries a vibrator pad 39 which contacts a face of the cast part.

A compressed air hose 40 provides compressed air from a conventional compressed air source (not shown) to one side of the piston 37 and is operated by a conventional timing valve 41 which turns the air flow on and off. Resisting the movement of the piston is a spring 42 within the cylinder. Thus, when the air valve 41 is turned off, the spring 42 moves the piston to the right, as shown in FIG. 3. Conversely, when the air valve 41 is turned on, the compressed air moves the piston to the left, against the force of the spring. In this manner, the pad 39 is vibrated rapidly.

Other forms of vibrators are commercially available, including electrically and electro-magnetically operated vibrators. Since they are commercially available, it is contemplated that any suitable vibrator, giving the desired speed of vibration, may be selected by those skilled in the art to perform the required vibration of the part. The amplitude and speed of vibration will depend upon the part size, shape and structure and can be determined by trail and error.

After the part is vibrated at the vibration station 32, it moves clockwise to an air blast station 44. Here, a gang of nozzles 45 are mounted upon a manifold 46 which is connected by a tube 47 to a valve 48. The valve communicates, through a pipe 49 to an air source 50. The air source, such as a compressed air tank or an air compressor, provides high pressure air, such as in the order of 100 to 110 PSIG. The air source provides short duration air bursts. Therefore, the air source system must be of a type which rapidly recovers its air pressure upon release of the air burst. Commercially available air turbines or compressors of sufficient capacity are available to supply high pressure air in short, rapidly applied bursts with rapid recovery.

The manifold 46 is mounted in such a manner as to move towards the cast part so that the nozzles 45 enter into or communicate with the entrances or openings 22 at one of the passageways 21. The means for moving the manifold towards the casting is schematically illustrated as comprising a lever 51 connected to a rotating shaft 52 on a reversible motor 53. Operation of the motor 53 moves the lever 51 to cause the manifold, with the nozzles to move either towards or away from the casting, as desired. Suitable controls are provided for cycling and operating the movement of the manifold. However, these are not shown since conventional, commercially available, controls may be used for this purpose.

A series of alternating vibrating stations are provided. Thus, the wheel rotates or indexes the metal part, after the air burst station 44 to the next vibration station **32*a*, then to air burst station 44*a*, vibration station 32*b*, and air burst station 44*b***. The number of these alternating stations may vary, depending upon the desired number of cleaning cycles through which the part is to be passed.

Since the cast part is rotated by the ferris wheel-like frame, the angle of the part, relative to horizontal, is changed as it cycles through the successive vibration and air burst stations. The movement of the frame is intermittent in that it rotate a predetermined number of degrees for indexing the part and then it is momentarily stationary while the part is treated at the respective vibrating and air burst stations.

The air burst is applied virtually instantaneously. For example, it may be applied within a matter of a few milliseconds like a shot or almost instantaneous blast of air.

After the part has passed through the vibration and air burst cycles, it may pass through a final air blast station 56 which is provided with one or more nozzles 57 controlled by a valve 58 for blasting compressed air upon and around the part and its openings. Compressed air is fed to the valve and the nozzles through a pipe 59 connected to a compressed air source 60. This compressed air source 60 may provide a steady air blast for a longer duration for completely air cleaning the part before it is indexed back to the load station 25.

Once the part returns to the loading station 25, it may be removed by releasing the clamps 26 and a fresh casting inserted in its place. Hence, the equipment may require some labor for loading and unloading the parts or may utilize some conventional material handling equipment for the purpose. Otherwise the operation of the equipment is automatic.

Because of the rotative movement which changes the angle of the part, the force of gravity helps dislodge sand and other casting debris from the walls of the openings and out of the openings. Thus, the successive application of vibrations and air bursts to the differently angled part either completely or substantially completely cleans the passageway walls.

This invention may be further developed within the scope of the following claims. Accordingly, it is desired that the foregoing description be read as being merely illustrative of an operative embodiment of this invention, and not in a strictly limited sense.

Having fully described an operative embodiment of this invention, we now claim:

1. A method of cleaning a plurality of metal castings, each casting having multiple passageways extending through the casting and opening at different surface portions of the casting, comprising:

rotating the plurality of castings along a circular path around a horizontal axis so that the passageways open downwardly for a sufficient period of time during which rotation occurs to enable sand and casting debris to drop from the passageways;

vibrating at least one of the castings for a period of time sufficient to loosen the debris said vibration produced by interrupting the rotation of the casting so that the casting is stationary, while the casting is vibrated to provide a cycle of alternating periods of vibration and periods of non-vibration;

simultaneously introducing a high pressure burst of air into the openings of the passageways of at least one of the castings at one of the casting surface portions for a sufficient period of time to blow out sand and other casting debris, said time duration that is measured in milliseconds during at least one of the period of non-vibration while rotating along the circular path;

whereby the alternating vibration and high pressure air bursts loosen and blow out of the passageways sand and any other casting debris containing therein, and the force of gravity causes loose sand and other casting debris to drop from the passageways during periods within the time that they are rotated when they open downwardly.

2. A method as defined in claim 1 and including interrupting the rotation of the casting, so that the casting is stationary, when the burst of air is introduced.

3. A method as defined in claim 2, and including rotating the casting, around the horizontal axis, along a circular path whose diameter is greater than the size of the casting measured in a direction radially from said horizontal axis so that the angle of the casting, relative to horizontal, is changed for each of the periods of vibration and introduction of bursts of air.

4. A method of cleaning sand and casting debris from a metal casting having at least one passageway extending through the casting and opening at different surface portions of the casting, comprising:

indexing the casting along a circular path having a plurality indexing stations along the circular path;

vibrating the casting at at least one indexing stations for a period of time sufficient to loosen casting debris in the passageways to provide a cycle of a desired period of vibration and a longer period of non-vibration;

simultaneously introducing a high pressure burst of air into one open end of the passageway at at least one of the indexing stations for a duration of time sufficient to blow casting debris from the passageway, the duration of time measured in milliseconds, during the period of non-vibration;

whereby the alternate vibration and high pressure burst of air applications loosen and blow sand and casting debris from the interior of the passageway.

5. A method as defined in claim 4 and including changing angle of the casting, relative to horizontal, for each of the vibration and burst of air applications.

6. A method as defined in claim 5, and including vibrating the casting and introducing high pressure bursts of air between at least one of the periods of vibration of the casting.

7. A method as defined in claim 6, and including rotating the casting around a horizontal axis so that angle of the passageway changes and the passageway opens downwardly during parts of its rotation;

whereby loosened sand and casting debris may gravity drop downwardly from the passageway opening when it opens downwardly for cleaning the interior of the casting.

8. A method as defined in claim 9, and including interrupting the rotation of the casting so that it is substantially stationary during the time periods that it is rotated and the time periods when the high pressure burst of air is introduced.

9. A method as defined in claim 8, wherein the circular path defines measured from the horizontal axis of rotation to the circular path, length of the radius, is a number of times greater than the radially measured length of the casting.

* * * * *

UNITED STATES PATENT AND TRADEMARK OFFICE

CERTIFICATE OF CORRECTION

PATENT NO. : 5,071,487

DATED : 12/10/91

INVENTOR(S) : Kenneth D. McKibben and Thomas E. Wuepper

It is certified that error appears in the above-identified patent and that said Letters Patent is hereby corrected as shown below:

Col. 2, Line 22: "t" should be --to--.

Col. 3, Line 52: "trail" should be --trial--.

Col. 4, Line 25: "rotate" should be --rotates--.

Col. 5, Line 19, Claim 1: "period" should be --periods--.

Col. 6, Line 32 Claim 8: "9" should be --7--.

Col. 6, Line 38, Claim 9: before "measured" insert --a radius--.

Signed and Sealed this

Thirtieth Day of March, 1993

*Attest:*

STEPHEN G. KUNIN

*Attesting Officer*

*Acting Commissioner of Patents and Trademarks*